United States Patent [19]

Scheurecker et al.

[11] Patent Number: 4,966,349

[45] Date of Patent: Oct. 30, 1990

[54] SUPPORTING ARRANGEMENT FOR CASTING LADLES PROVIDED IN A CONTINUOUS CASTING PLANT

[75] Inventors: Werner Scheurecker; Ronald Spannlang, both of Linz; Istvan Kalmar, Vienna; Manfred Leutgób, Ennsdoft; Armin Schertler, Vienna, all of Austria

[73] Assignee: Voest-Alpine Industrienlagenbau, Linz, Austria

[21] Appl. No.: 479,965

[22] Filed: Feb. 14, 1990

[30] Foreign Application Priority Data

Feb. 15, 1989 [AT] Austria ..... A335/89

[51] Int. Cl.[5] ..... B22D 41/00

[52] U.S. Cl. ..... 266/276; 164/437

[58] Field of Search ..... 266/275, 276; 222/591; 164/335, 337, 437, 438

[56] References Cited

U.S. PATENT DOCUMENTS

| | | | |
|---|---|---|---|
| 4,436,293 | 3/1984 | Schmidt et al. | 266/276 |
| 4,603,841 | 8/1986 | Scheurecker et al. | 164/437 |
| 4,751,956 | 6/1988 | Benedetti | 266/276 |

*Primary Examiner*—S. Kastler

*Attorney, Agent, or Firm*—Hopgood, Calimafde, Kalil, Blaustein, & Judlowe

[57] ABSTRACT

A supporting arrangement for casting ladles includes a stationarily mounted permanent base and a rotary base rotatably mounted relative to the permanent base. To each rotary base, a supporting bracket system is hinged via a linkage parallelogram system including pivotable guiding rods. Each supporting bracket system is liftable and lowerableby a pressure medium cylinder. In order to reduce the weight of the supporting arrangement and to facilitate any repair work to be done at the pressure medium cylinder, the supporting bracket system is composed of two independent supporting brackets, each supporting bracket independently being hinged to a lower and an upper guiding rod of the linkage parallelogram system. The upper guiding rods of the linkage parallelogram system, on their ends facing away from the rotary base, are united by a cross beam to a rigid unit U-shaped in ground plan. The cross beam is supported on the pressure medium cylinder by a swivel arranged in alignment with the hinges of the upper guiding rods, which hinges are arranged on the ends facing away from the rotary base.

5 Claims, 2 Drawing Sheets

SUPPORTING ARRANGEMENT FOR CASTING LADLES PROVIDED IN A CONTINUOUS CASTING PLANT

Figure 1:
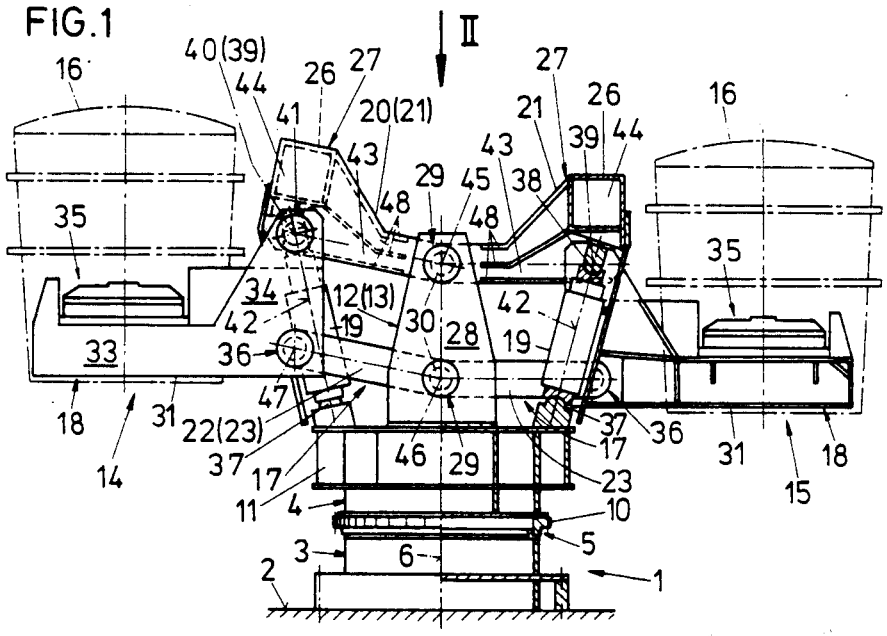

The invention relates to a supporting arrangement for casting ladles in a continuous casting plant, comprising a stationarily mounted permanent base and a rotary base rotatably mounted relative to the permanent base by means of a rotation drive and to which at least one supporting bracket system for retaining a casting ladle is hinged by means of a linkage parallelogram system composed of superimposed guiding rods pivotable about horizontal axes, which supporting bracket system is liftable and lowerable relative to the rotary base by means of at least one pressure medium cylinder.

An arrangement of this type is known from EP-A-0 277 846. With this arrangement, the linkage parallelogram system is composed of upper and lower guiding rods, the upper guiding rods and the lower guiding rods, respectively, each being connected by carriers or connecting rods. The supporting bracket system is formed by a frame U-shaped in ground plan and embracing a casting ladle, on the free ends of which frame the casting ladle is supported and whose cross beam connecting the legs of the U, which is designed as a box girder, is engaged by a pressure medium cylinder, by the aid of which the supporting arm system is liftable and lowerable. In addition, the upper guiding rods of the linkage parallelogram system are hinged to this box girder.

The great number of cross beams and connecting rods implies a heavy and material consuming structure, which is accordingly expensive. Moreover, the known structure is hardly accessible from above so that any exchange of pressure medium cylinders in case of repair is hardly feasible from above by means of a crane without having to disassemble the supporting arrangement into its individual elements.

Furthermore, a supporting arrangement for casting ladles at a continuous casting plant comprising a linkage parallelogram system and a supporting bracket system, is known from DE-A- 24 30 786. With this supporting arrangement, pressure medium cylinders each supported on a rotary column of the supporting arrangement by one end, with their other ends directly engage at the guiding rods, the guiding rods, at the same time, being subjected to a bending stress by the pressure medium cylinders, thus, having to be constructed accordingly complex. Moreover, two pressure medium cylinders per supporting bracket system are required with this construction, which must operate synchronously and, hence, involve considerable expenditures. As a further disadvantage, this known structure has a considerable structural height.

The invention aims at avoiding these disadvantages and difficulties and has as its object to provide a supporting arrangement of the initially defined kind, whose guiding rods of the linkage parallelogram system only are stressed by tension and pressure forces such that these guiding rods may be designed particularly lightweight. In particular, as small a number of cross beams as possible is to suffice in order that the components of the supporting arrangement, in particular its pressure medium cylinders, be accessible from above in a simple way and any repair may be carried out by the aid of the hall crane in a quick and cheap way. In accordance with the invention, this object is achieved in that 10 the supporting bracket system is comprised of two independent supporting brackets, each supporting bracket independently being hinged to a lower and an upper guiding rod of the linkage parallelogram system, the upper guiding rods of the linkage parallelogram system, on their ends facing away from the rotary base, are united by means of a cross beam to a rigid unit U-shaped in ground plan, and that the cross beam is supported on the at least one pressure medium cylinder by means of a swivel, the swivel being aligned with the hinges of the upper guiding rods, which hinges are arranged on the ends facing away from the rotary base.

A preferred material-saving structure is characterized in that the rotary base is formed by a turning platform and by standards vertically rising from the same and arranged in the region of the external periphery of the turning platform, and that the upper and lower guiding rods are hinged to the standards.

In this case, the upper and lower guiding rods, suitably, are hinged to the standards by means of hinges superimposed in the vertical direction.

A particularly simple structure comprising two diametrically oppositely arranged linkage parallelogram systems and the pertaining supporting bracket systems for retaining one casting ladle each is characterized in that the upper guiding rods and the lower guiding rods of the two linkage parallelogram systems each are hinged to the standards by registering axes.

Preferably, the upper guiding rods are L-shaped in the side view, each upper guiding rod being formed by an arm extending from the hinge on the rotary base to the hinge on the supporting bracket and by an arm of the L rising from the hinge of the supporting bracket, and the cross beam is connected with the upper guiding rods on the upper end of each arm rising from the hinge of the supporting bracket. Thereby, housing of the bearings that link the pressure medium cylinders to the cross beams is particularly simple such that these bearings are readily accessible and the pressure medium cylinders are easily detachable from the cross beams and removable from the arrangement.

Figure 2:
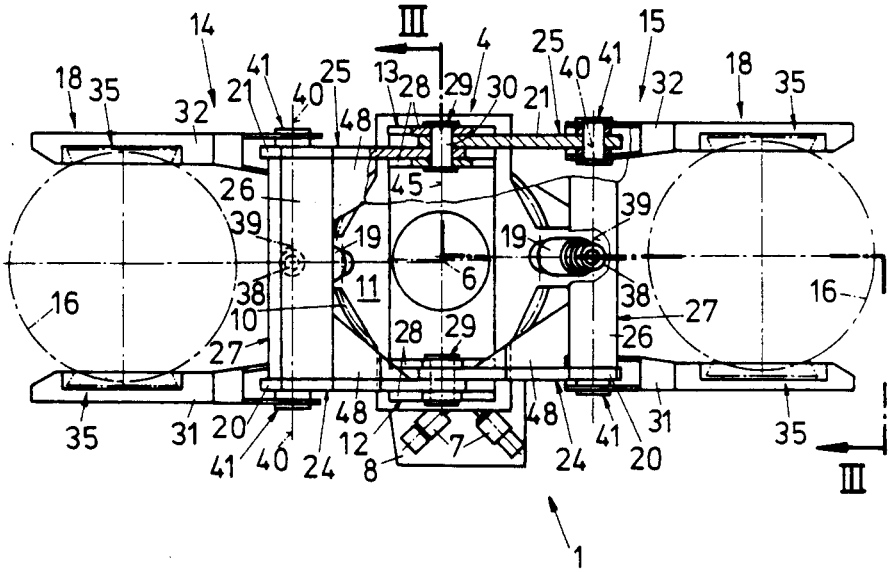
Figure 3:
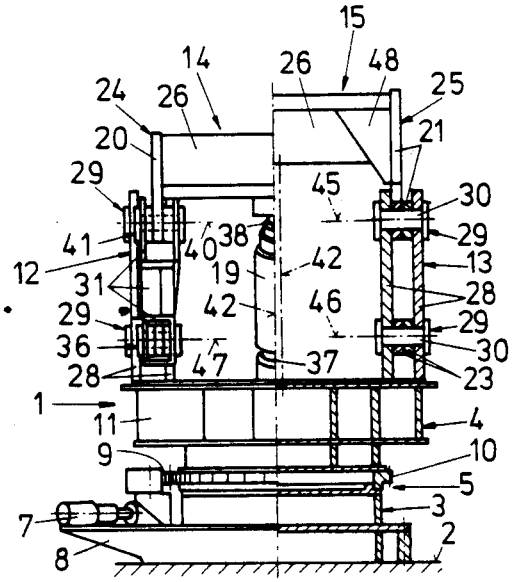

The invention will now be explained in more detail by way of an exemplary embodiment with reference to the accompanying drawing, wherein: FIG. 1 is a schematic side view partially sectioned; FIG. 2 represents a view in the direction of the arrow II of FIG. 1, also partially sectioned; and FIG. 3 is a sectioned illustration along line III-13 III of FIG. 2.

A supporting arrangement 1 comprises an annular permanent base 3 of a slight structural height as compared to its diameter, which is stationarily mounted on a casting platform 2 of a continuous casting plant. On the permanent base, a rotary base 4 is mounted by means of a drive ring bearing 5 so as to be rotatable about a vertical rotation axis 6 registering with the central axis of the permanent base 3, the rotational movement being accomplished by means of rotation drive motors 7 mounted on a cantilever 8 of the permanent base 3. The motors 7 drive pinions 9 engaging in a gear rim 10 provided on the rotary base 4. The rotary base 4 is formed by a turning platform 11, from which two parallel vertical standards 12, 13 rise, which are each fastened in the region of the external periphery of the turning platform and are located diametrically opposite each other.

Two lifting means 14, 15 for lifting and lowering one casting ladle 16 each are arranged on the standards 12, 13 and are directed in opposite directions. Each lifting means is comprised of a linkage parallelogram system 17 hinged to the standards 12, 13 and of a supporting bracket system 18 hinged to the linkage parallelogram system 17 as well as by a pressure medium cylinder 19, such as a hydraulic cylinder.

Each linkage parallelogram system 17 comprises two upper guiding rods 20, 21 and two lower guiding rods 22, 23' of which one upper guiding rod 20, 21 and one lower guiding rod 22, 23 are each hinged to one standard 12, 13 so as to be pivotable in the vertical direction Thus, two parallel linkage parallelograms 24, 25 are formed, which extend in the vertical direction. The upper guiding rods 20, 21 of these two linkage parallelograms 24, 25 are combined by a cross beam 26 to a rigid unit 27 Ushaped in ground plan the synchronous movement of the two linkage parallelograms 24, 25, thus, being ensured.

As is apparent from FIG. 2, each standard 12, 13 is constituted by two parallel plates 28, the hinges 29 of the linkage parallelograms 24, 25 being formed by hinge Pins 30 extending from one plate 28 to the other one. The upper guiding rods 20, 21 and the lower guiding rods 22, 23 of the two linkage parallelogram systems 17 of the lifting means 14, 15 are each arranged in alignment in order to save space such that the upper and lower guiding rods 20, 21; 22, 23 of the two linkage parallelogram systems 17 are each mounted on one and the same hinge pin The coupler of each of the two linkage parallelograms 24, 25 is formed by the supporting bracket system 18, which comprises two independent supporting bracket 31, 32 L-shaped in side view. Each supporting bracket 31, 32 has a horizontal section 33 and a vertical section 34, each vertical section 34 being hinged to a lower guiding rod 22, 23 and an upper guiding rod 20, 21 and the horizontal section 33 extending outwardly from the vertical section 34 and including a seat 35 for the casting ladle 16 on its free end. The hinges 29 connecting the guiding rods 20, 21; 22, 23 with the standards 12, 13, like the hinges 36 connecting the lower guiding rods 22, 23 with the supporting brackets 31, 32, are designed as hinges that are spherically movable to a limited extent.

The vertical movement of the supporting bracket system 18 is obtained by means of the pressure medium cylinder 19, which is hinged to the turning platform 11 by means of a bearing 37, on the one hand, and to the cross beam 26 of the linkage parallelogram system 17 by means of a swivel 38, on the other hand. The swivel 38 connecting the pressure medium cylinder 19 with the cross beam 26 is arranged in a manner that its bearing axis 39 registers with the axes 40 of hinges 41 connecting the two upper guiding rods 20, 21 with one supporting bracket 31, 32 each, and that the effective line 42 of the force generated by the pressure medium cylinder 19 runs through the imaginary horizontal line of connection of the hinges 41 connecting the upper guiding rods 20, 21 with the supporting brackets 31, 32. Thus, the upper guiding rods 20, 21 are stressed only by tension so that they may be designed in a weight and expenditure saving manner.

In order to be able to realize this construction in a simple manner, the upper guiding rods 20, 21 are designed substantially L-shaped, seen from the side, a first arm 43 of the L, which is hinged to the standard 13, 14, on the one hand, and to the supporting bracket 31, 32, on the other hand, extending parallel to the respective lower guiding rod 22, 23, and a second arm 44 of the L extending vertically upwards at a right angle to the first arm 43 of the L. To the upper end of the second arm 44, the cross beam 26 is welded, which extends horizontally to the opposite upper guiding rod 20, 21 and parallel to the horizontal axes 40, 45, 46, 47 of the hinges 29, 36, 41 of the linkage parallelograms 24, 25. Reinforcement ribs 48 serve to reinforce the U-shaped structural unit 27 comprised of the upper guiding rods 20, 21 and of the cross beam 26.

By designing this structural unit 27 in such a manner, it is possible to fasten the swivel 38, by which the pressure medium cylinder 19 is hinged to the cross beam 26, below the cross beam 26 to the same in a simple manner such that the cross beam 26 will not be weakened by recesses and the alignment of the swivel 38 with the hinges 41 will be ensured in any position of the guiding rods 20, 21, 22, 23.

The removal of a pressure medium cylinder 19 is particularly simple; it is merely necessary to lift the linkage parallelogram system 17 either by the defect pressure medium cylinder itself or by means of an external lifting means and to remove the pressure medium cylinder from the supporting arrangement upwardly through the free space between the cross beam 26 and the two guiding rods 20, 21 by means of a crane.

What we claim is:

1. In a supporting arrangement for casting ladles provided in a continuous casting plant and including a stationarily mounted permanent base, a rotary base, a rotation drive adapted to rotate said rotary base relative to said permanent base, at least one supporting bracket system adapted to retain a casting ladle, a linkage parallelogram system composed of a plurality of superimposed guiding rod means and adapted to hinge said at least one supporting bracket system to said rotary base, said guiding rod means including upper guiding rods and lower guiding rods and being pivotable about horizontal axes, and at least one pressure medium cylinder for lifting and lowering said supporting bracket system relative to said rotary base, the improvement comprising two independent supporting brackets forming said supporting bracket system, each of said supporting brackets being separately hinged to one of said lower and one of said upper guiding rods of said linkage parallelogram system.

a cross beam for uniting said upper guiding rods of said linkage parallelogram system on their ends facing away from said rotary base so as to form a unit, said unit being U-shaped in ground plan, a swivel adapted to support said cross beam on said at least one pressure medium cylinder and first hinge means arranged on said upper guiding rods on their ends facing away from said rotary drive so as to be in alignment with said swivel.

2. A supporting arrangement as set forth in claim 1, wherein said rotary base is comprised of a turning platform and of standards vertically rising therefrom and arranged in the region of the external periphery of said turning platform, said upper and lower guiding rods being hinged to said standards.

3. A supporting arrangement as set forth in claim 2, further comprising second hinge means provided on said upper and said lower guiding rods in a manner superimposed in the vertical direction and adapted to hinge said upper and said lower guiding rods to said standards.

4. A supporting arrangement as set forth in claim 3, wherein two diametrically oppositely arranged linkage parallelogram systems and their pertaining supporting bracket systems are provided, each of said supporting bracket systems retaining one casting ladle, and wherein said rotary base is comprised of a turning platform and of standards vertically rising therefrom and arranged in the region of the external periphery of said turning platform, the upper guide rods of the two linkage parallelogram systems being hinged to said standards with their axes being aligned and the lower guide rods of the two linkage parallelogram systems being hinged to said standards with their axes being aligned.

5. A supporting arrangement as set forth in claim 1, wherein said rotary base is comprised of a turning platform and of standards vertically rising therefrom and arranged in the region of the external periphery of said turning platform, second hinge means being provided on said upper and said lower guiding rods in a manner superimposed in the vertical direction for hinging said upper and said lower guiding rods to said standards, wherein each of said upper guiding rods, in the side view, is designed like an L having a first arm extending from said second hinge means on said rotary base to said first hinge means on said supporting bracket and a second arm rising from said first hinge means of said supporting bracket, and wherein said cross beam is connected with said upper guiding rods on the upper end of each second arm.

* * * * *